US008174197B2

(12) United States Patent
Ghanem et al.

(10) Patent No.: US 8,174,197 B2
(45) Date of Patent: May 8, 2012

(54) POWER CONTROL CIRCUIT AND METHOD

(75) Inventors: Mohamed Cherif Ghanem, Pierrefonds (CA); Eden Dubuc, Saint-Michel (CA)

(73) Assignee: GE Lighting Solutions LLC, Cleveland, OH (US)

( * ) Notice: Subject to any disclaimer, the term of this patent is extended or adjusted under 35 U.S.C. 154(b) by 464 days.

(21) Appl. No.: 12/420,923

(22) Filed: Apr. 9, 2009

(65) Prior Publication Data

US 2010/0259191 A1 Oct. 14, 2010

(51) Int. Cl.
*H05B 33/02* (2006.01)

(52) U.S. Cl. ..... 315/129; 315/130; 315/247

(58) Field of Classification Search ..... 315/209 R, 315/225, 226, 209 CD, 209 M, 291, 307, 315/308, 362, DIG. 5, DIG. 7, 246
See application file for complete search history.

(56) References Cited

U.S. PATENT DOCUMENTS

| | | | | |
|---|---|---|---|---|
| 6,091,614 | A | 7/2000 | Malenfant | |
| 6,153,985 | A | 11/2000 | Grossman | |
| 6,285,139 | B1 | 9/2001 | Ghanem | |
| 6,618,031 | B1 | 9/2003 | Bohn, Jr. et al. | |
| 6,762,563 | B2 * | 7/2004 | St-Germain et al. | 315/129 |
| 2005/0002134 | A1 | 1/2005 | Ohtake et al. | |
| 2006/0197470 | A1 * | 9/2006 | Ribarich et al. | 315/291 |
| 2007/0024213 | A1 | 2/2007 | Shteynberg et al. | |
| 2008/0018261 | A1 | 1/2008 | Kastner | |

FOREIGN PATENT DOCUMENTS

WO WO 2006/096638 A2 9/2006

OTHER PUBLICATIONS

European Search Report dated Jul. 2, 2010.

* cited by examiner

*Primary Examiner* — Shawki S Ismail
*Assistant Examiner* — Christopher Lo
(74) *Attorney, Agent, or Firm* — Fay Sharpe LLP

(57) ABSTRACT

A light source with substantially constant intensity and power consumption is provided. The light source includes a controllable dc voltage and current source; a non-linear light-emitting load supplied with dc voltage and current from the controllable dc voltage and current source; a current sense circuit connected in series with the non-linear light-emitting load; a variable LED forward voltage (varying with temperature, binning batch, aging) sensor circuit; a multiplier operative to measure a power-representative signal; and a power consumption control feedback circuit through which the dc voltage and current source is controlled in relation to the variable forward voltage representative signal to adjust the dc voltage and then a current to amplitudes that keep the light intensity and power consumption produced by the light source substantially constant.

17 Claims, 8 Drawing Sheets

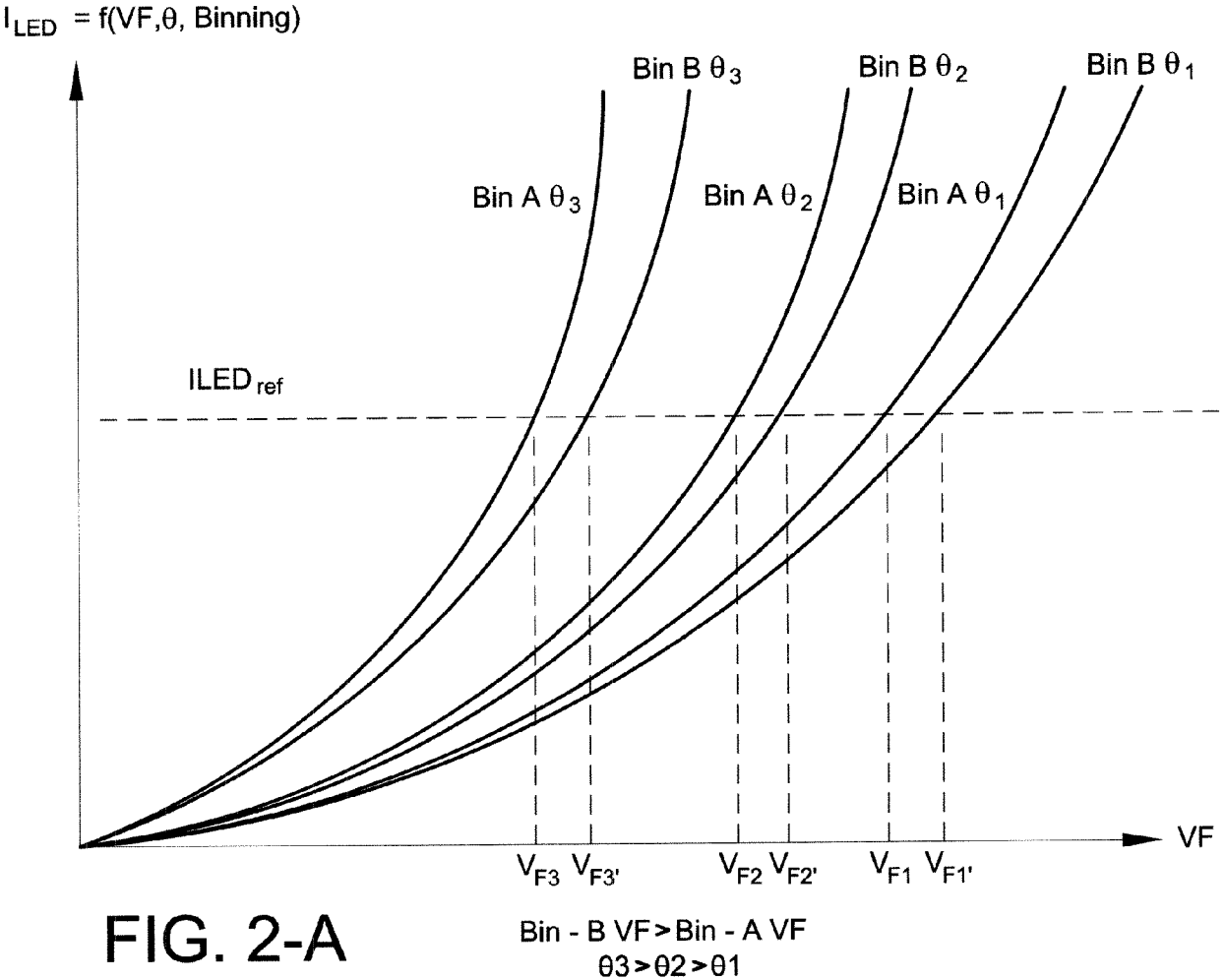
FIG. 2-A

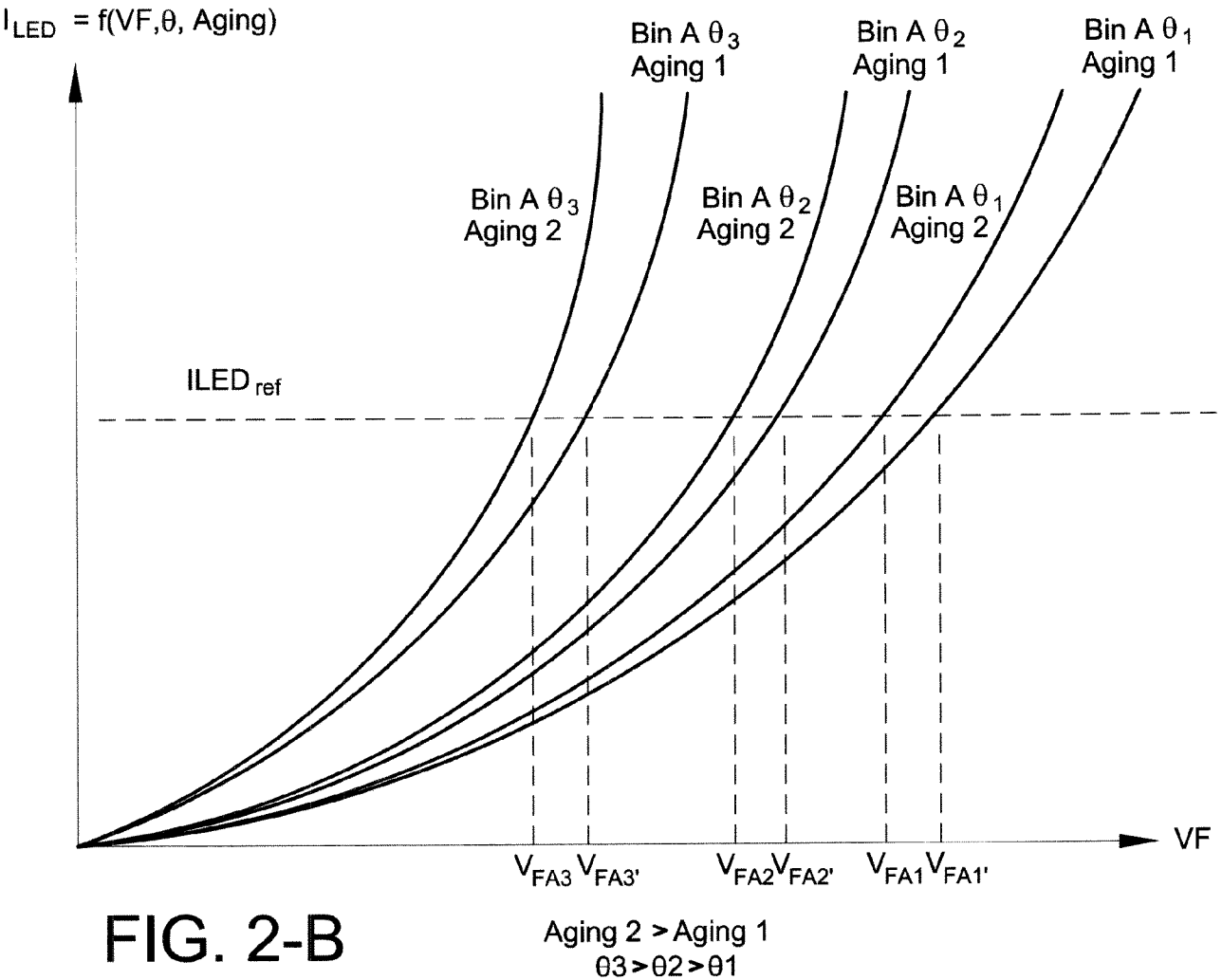
FIG. 2-B

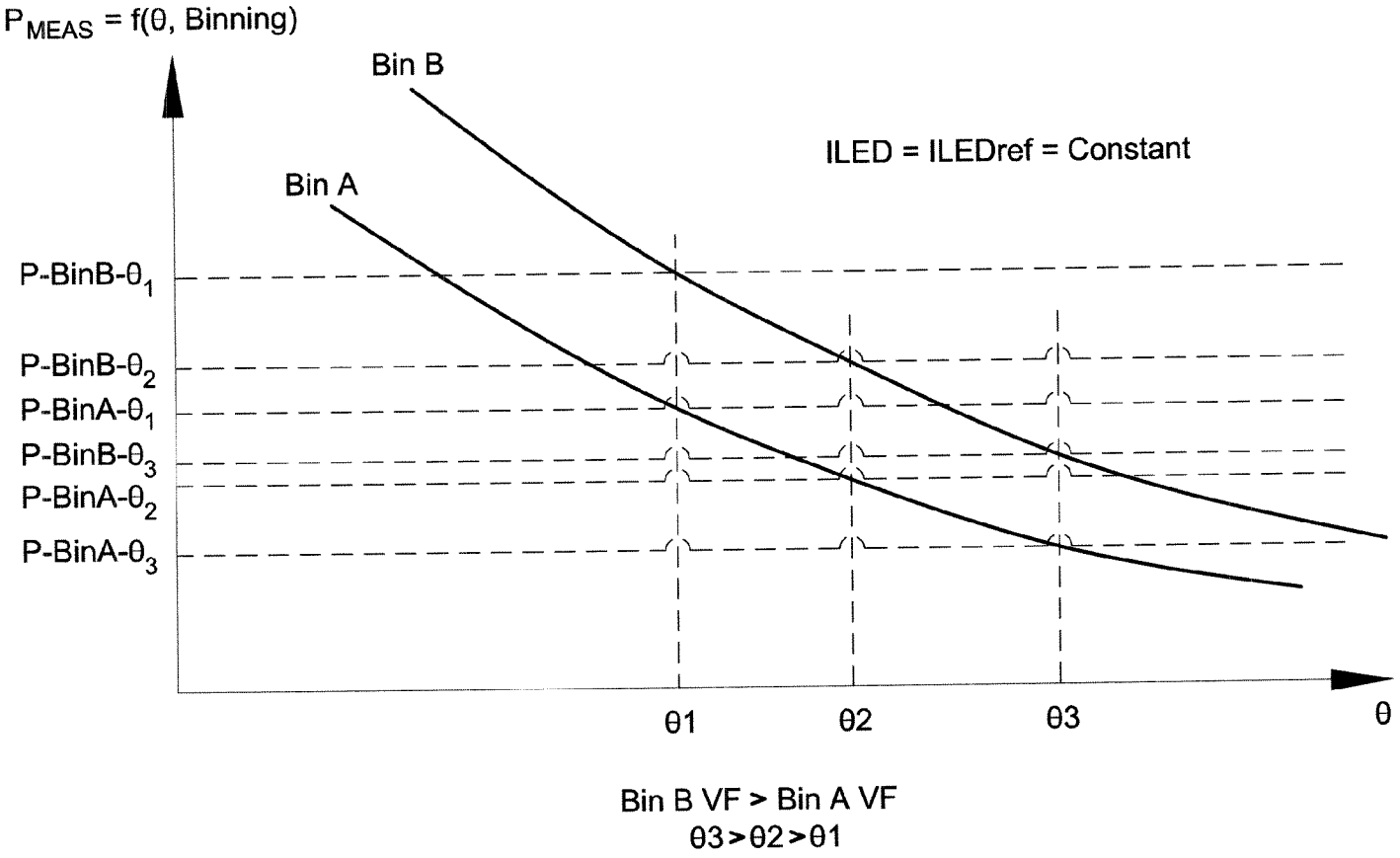
FIG. 3-A

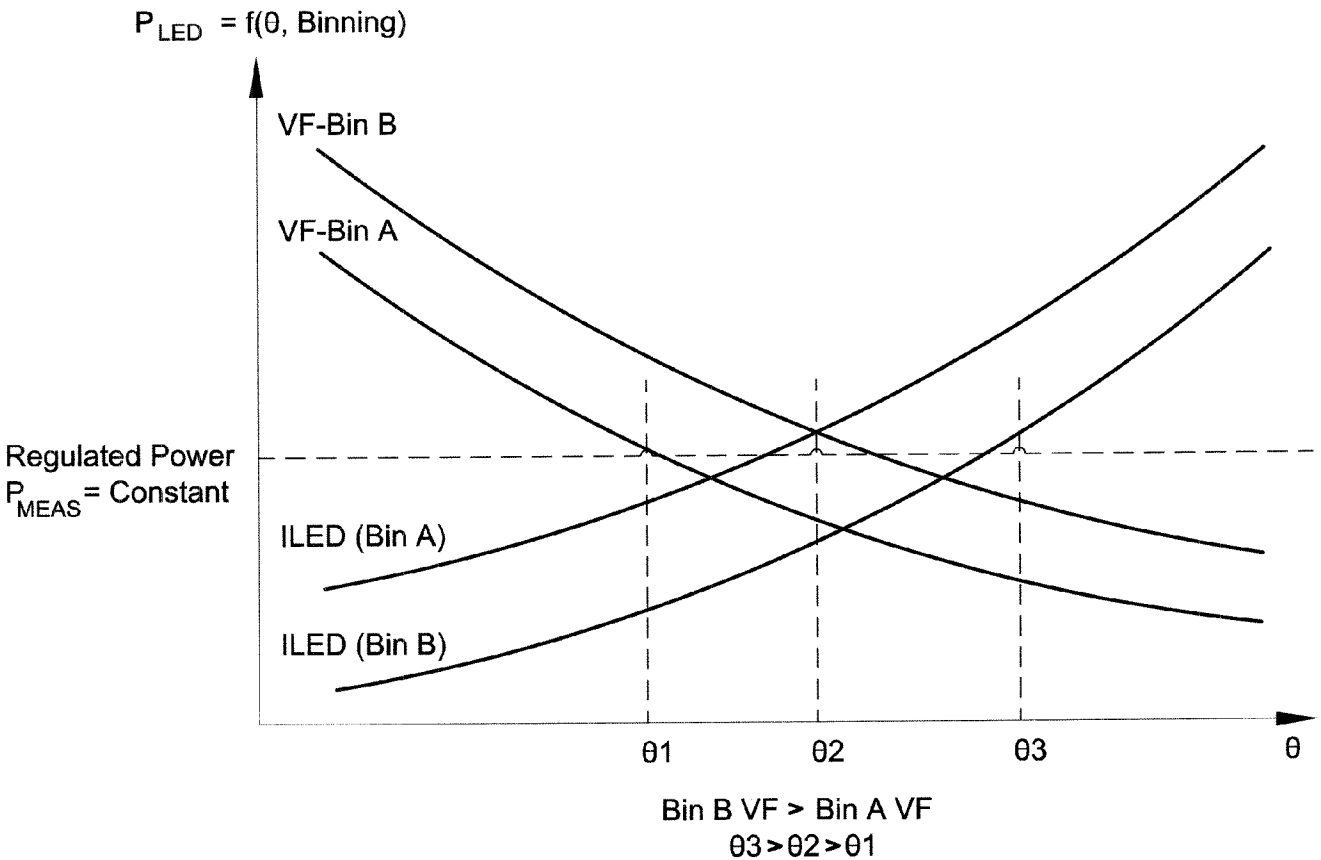
FIG. 4-A

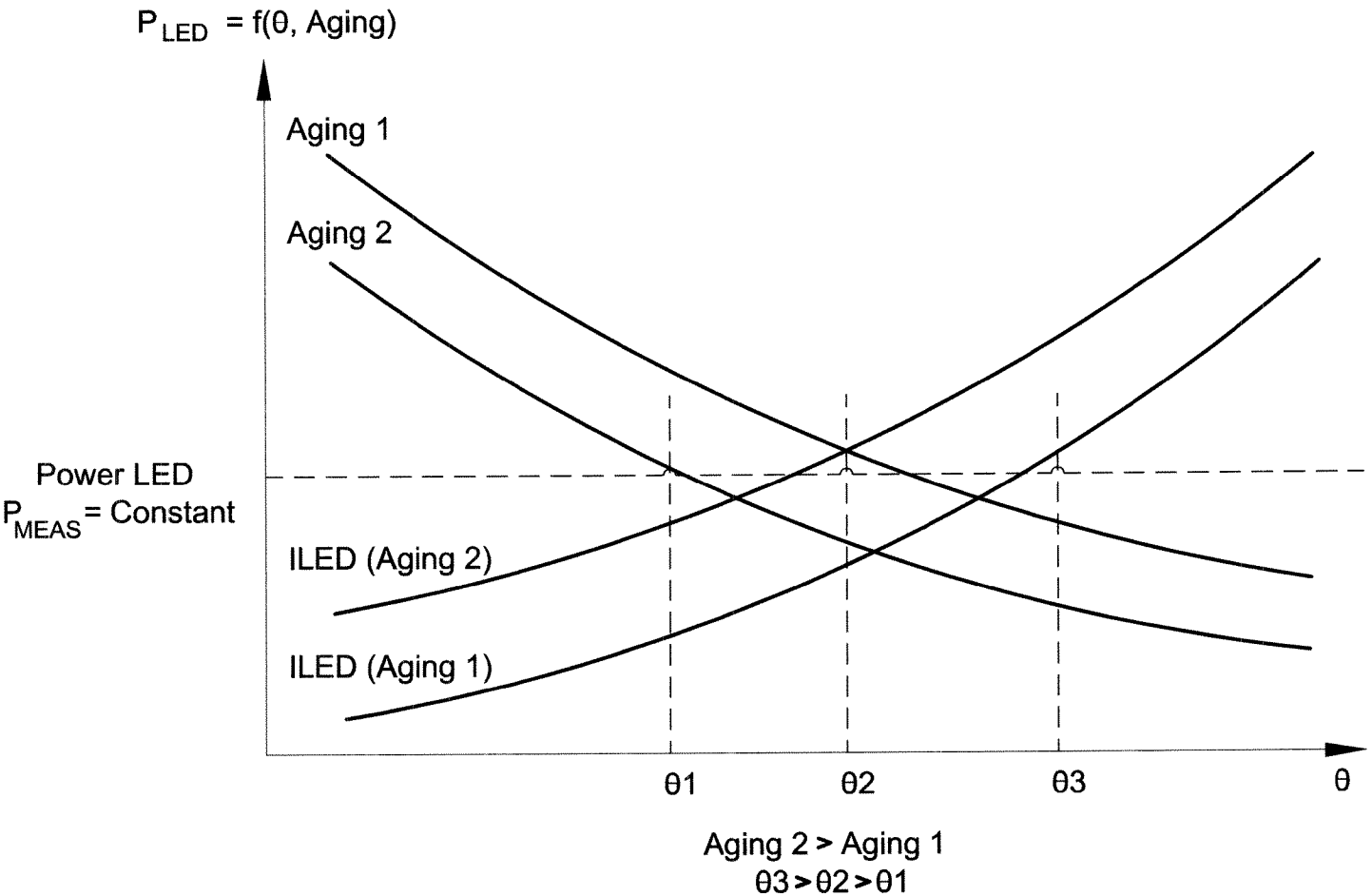
FIG. 4-B

POWER CONTROL CIRCUIT AND METHOD

BACKGROUND OF THE INVENTION

The present invention relates to a power control circuit for providing a substantially constant intensity light source and a corresponding method using this control circuit.

By way of background, traffic signal lamps typically use either incandescent or LED (light-emitting diode) lamps. LED traffic signals are more reliable, more mechanically stable, safer, more energy efficient and more environmentally friendly than incandescent lamps. Thus, LED traffic signals are gaining in popularity.

The voltage and current characteristics of an LED lamp are sensitive to temperature. The LEDs used will have a forward voltage specified at an intended operating current. In particular, the forward voltage changes with the temperature, and, consequently, the current follows the variation. Thus, if the forward voltage increases, then the forward current will decrease. Likewise, if the forward voltage decreases, then the forward current increases.

For example, for a given type of LED widely used in the fabrication of traffic lights and signals, rail signals, signage, commercial refrigeration lighting, general Illumination, vehicle lighting, variable message and many other applications, a constant voltage of 1.8 volts will produce in the LED a current of about 7.5 mA at a temperature of −25° C., a current of about 20.5 mA at a temperature of +25° C., and a current of about 30 mA at a temperature of +60° C. The magnitude of the current through the light-emitting diode at a temperature of +60° C. is therefore, for a constant voltage of 1.8 volt, about 1.6 times higher than the magnitude of the current at a temperature of +25° C.

A constant voltage may be maintained such that the voltage across the LEDs is constant for all environments (e.g., −40 to 74° C.). It is known that at high temperatures the forward voltage of the LEDs decreases, and because the driver or the power supply maintains the voltage across the LEDs constant, the LED current will increase exponentially and stress the LEDs (bright LEDs).

At low temperatures the forward voltage of the LEDs increases, and because the driver of the power supply maintains the voltage across the LEDs constant, the LED current will decrease exponentially and the light will be dim (dim LEDs). Therefore, voltage feedback control may be detrimental to the service life of such an LED.

Also, a fixed LED output current presents the following drawbacks: at higher temperature the LED forward voltage decreases and then the output LED power decreases, which means light out decreases; and at lower temperatures the LED forward voltage increases and then the output LED power increases, which means light out increases.

Thus, there is a need for a device and method that eliminates the above-discussed drawbacks of the prior art by regulating the output power, and hence the light intensity, of non-linear light emitting loads such as light-emitting diodes.

INCORPORATION BY REFERENCE

The following patents, the disclosures of each being totally incorporated herein by reference, are mentioned:

U.S. Pat. No. 6,091,614 to Malenfant, entitled "VOLTAGE BOOSTER FOR ENABLING THE POWER FACTOR CONTROLLER OF A LED LAMP UPON LOW AC OR DC SUPPLY;"

U.S. Pat. No. 6,285,139 to Ghanem, entitled "NON-LINEAR LIGHT-EMITTING LOAD CURRENT CONTROL;" and U.S. Pat. No. 6,400,102 to Ghanem, entitled "NON-LINEAR LIGHT-EMITTING LOAD CURRENT CONTROL."

SUMMARY OF THE INVENTION

In accordance with an aspect of the present invention a light source is provided. The light source includes a controllable power source for supplying power to a non-linear light-emitting load; a current sensing circuit connected to the non-linear light-emitting load that generates a current signal representing the current flowing through the non-linear light-emitting load; a voltage sensing circuit connected to the non-linear light-emitting load that generates a voltage signal representing the voltage across the non-linear light-emitting load; a power sensing circuit connected to the current and voltage sensing circuits that receives the current and voltage signals and measures the power consumption of the light-emitting load and generates a variable power-representative signal; and a power feedback control circuit connected between the power sensing circuit and the controllable power source through which the power source is controlled in relation to the variable power-representative signal to maintain the power consumption of the light source substantially constant.

In accordance with another aspect of the present invention a method of maintaining the intensity and power consumption of a light source substantially constant is provided. The method includes supplying a controllable dc voltage and current to a non-linear light-emitting load; multiplying an output forward voltage and a variable current-representative signal from the light-emitting load to generate a variable power-representative signal; and feedback controlling the controllable dc voltage and current in relation to the variable power-representative signal to keep the light intensity produced by the light source substantially constant.

In accordance with yet another aspect of the present invention a substantially constant intensity LED lamp is provided. The lamp includes a controllable dc voltage and current source for supplying an LED load with dc voltage and current; a current sensing circuit connected with the LED load that generates a current signal representing the current flowing through the LED load; a voltage sensing circuit connected with the LED load that generates a voltage signal representing the voltage across the LED load; a multiplier circuit that receives the current signal and the voltage signal and generates a variable-power representative signal; and a voltage and current control feedback circuit connected between the power sense circuit and the controllable dc voltage and current source that receives the variable-power representative signal and controls the dc voltage and current source in relation to the variable power-representative signal to thereby adjust the dc voltage and current to keep the light intensity and power consumption produced by the LED load substantially constant.

BRIEF DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

FIG. 2A is a graph showing LED current as a function of LED forward voltage at different temperatures and different binning;

FIG. 2B is a graph showing LED current as a function of LED voltage at different temperatures and different aging;

FIG. 3A is a graph showing LED power as a function of temperature and $V_F$ binning;

FIG. 4A is a graph showing LED regulated power as a function of temperature and how the LED current is adjusted by a controllable dc voltage and current source as a function of the LED forward voltage variations due to temperature;

FIG. 4B is a graph showing LED regulated power as a function of temperature and how the LED current is adjusted by a controllable dc voltage and current source as a function of the LED forward voltage variations due to aging.

DETAILED DESCRIPTION

Although the exemplary embodiments of the present invention will be described hereinafter with reference to a light source such as a light-emitting diode (LED) traffic signal lamp, it may be used in other LED lighting applications such as rail signals, signage, commercial refrigeration, general Illumination, vehicle lighting, variable message and many other applications, and it should be understood that this example is not intended to limit the range of applications of the present invention.

Figure 1:
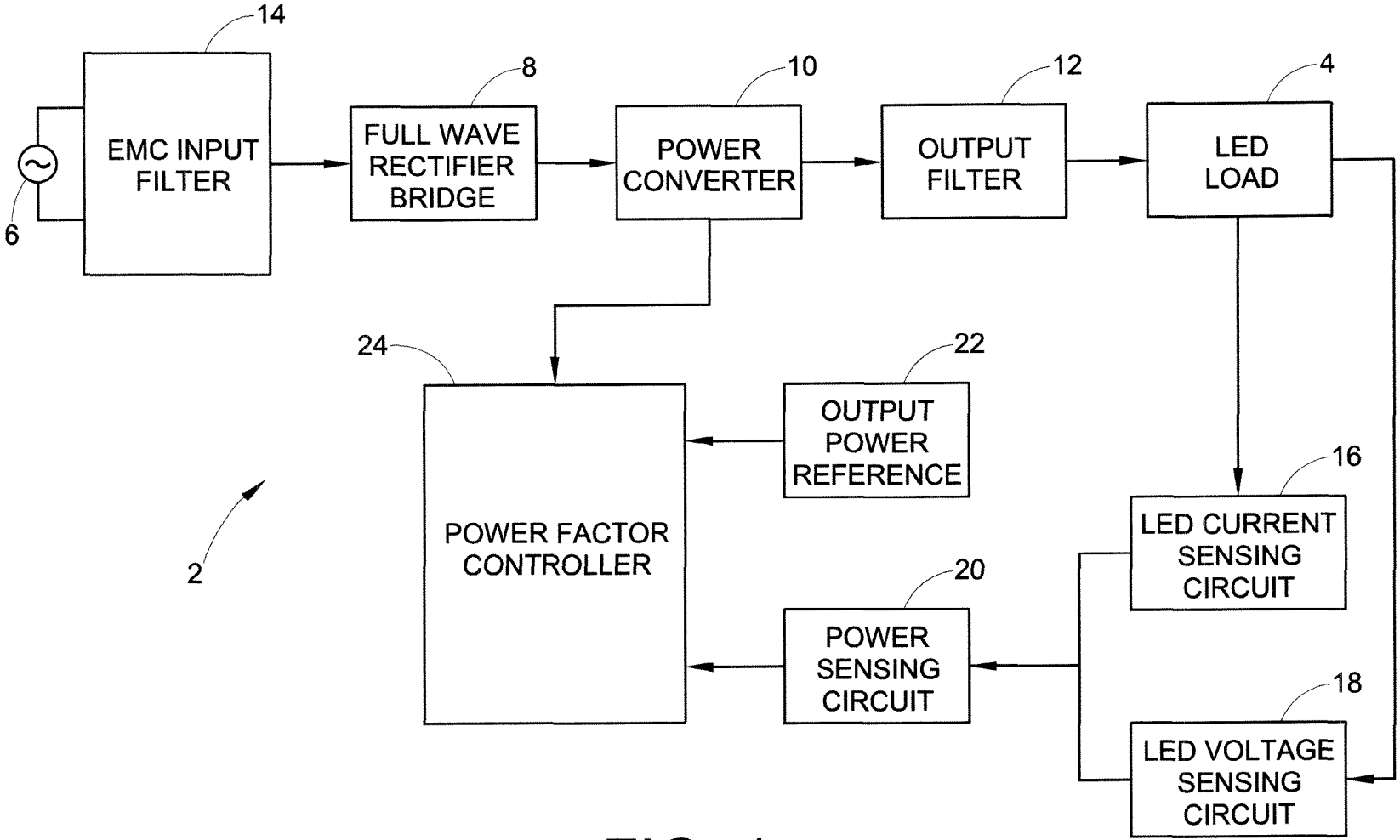
FIG. 1 is a block diagram of an LED lamp incorporating a power control system according to aspects of the invention.

Referring now to the drawings wherein the showings are for purposes of illustrating the exemplary embodiments only and not for purposes of limiting the claimed subject matter, FIG. 1 shows a block diagram of a light source 2, such as an LED traffic signal lamp. The light source 2 includes a non-linear load 4 comprising at least one set of LEDs. The set is typically formed of a plurality of subsets of LEDs, wherein the LEDs within each subset are serially interconnected. The subsets of serially interconnected LEDs are generally connected in parallel to form the set.

The light source 2 is supplied by an ac input line 6. The voltage and current from the ac input line 6 is rectified by a full wave rectifier bridge 8 and is supplied to the LED load 4 through a power converter (or power supply) 10 and an output filter 12.

The power converter 10 takes the ac voltage from the ac input line 6 and transforms it into dc voltage, with a regulated current, to power the LED load 4. A switching power supply may be used.

To smooth out the ac current waveform and withdraw the switching high frequencies therefrom, an electromagnetic compatibility (EMC) input filter 14 may be added between the ac source 6 and the full wave rectifier bridge 8. The EMC input filter 14 typically contains an arrangement of capacitors, inductors and common mode chokes to reduce conducted electromagnetic emissions. Filtering is necessary due to the noisy nature of a switching power supply. The current flowing through the EMC input filter 14 is proportional to the full-wave rectified voltage at the output of the rectifier bridge 8. The current waveform is sinusoidal and in phase with the voltage waveform so that the power factor is, if not equal to, close to unity.

The LED load 4 is connected to an LED current sensing circuit 16 that can be employed to verify that the current drawn by the LED load 4 is within acceptable operating parameters. Also, the LED load 4 is connected to an LED voltage sensing circuit 18. The outputs of the LED current sensing circuit 16 and the LED voltage sensing circuit 18, respectively, are connected to a power sensing (or multiplier) circuit 20.

The fixed output power reference signal $P_{REF}$ for each subset of LEDs is represented in FIG. 1 by reference numeral 22. The power drawn by the LED load 4 is thus measured by the power sensing circuit 20, which is serially interconnected between the terminals of a power factor controller 24 and the LED current sensing circuit 16 and the LED voltage sensing circuit 18. The power sensing circuit 20 generally multiplies the LED current $I_{LED}$ and the LED voltage $V_{LED}$ (i.e., $I_{LED} \times V_{LED}$) sensed by the current sensing circuit 16 and the voltage sensing circuit 18, respectively. In this manner, the power sensing circuit 20 converts the total power drawn by the LED load 4 to a corresponding power-representative voltage signal $P_{MEAS}$ present on an output of the power sensing circuit 20. The power sensing circuit 20 may comprise an analog multiplier circuit or a digital multiplier circuit. The corresponding power-representative voltage signal from the power sensing circuit 20 is connected to a power factor controller 24.

A function of the power factor controller 24 is to ensure that the input current follows the input voltage in time and amplitude proportionally. This means that, for steady-state constant output power conditions, the input current amplitude will follow the input voltage amplitude in the same proportion at any instant in time. The power factor controller 24 requires on its input at least two parameters: (1) the power representative feedback signal $P_{MEAS}$ (generated by the power sensing circuit 20) that varies with the LED load variation and (2) the output power reference $P_{REF}$.

The output power control loop, which comprises at least three circuits (in this case, the LED current sensing circuit 16, the LED voltage sensing circuit 18 and the power sensing circuit 20), is forced to have a slow response to allow the input current to follow the input voltage. Because of this slow power loop response, it is necessary to optimize the power factor controller 24 with respect to its action on the power converter 10 as a function of the temperature and forward voltage variation.

As noted earlier, to obtain the power-representative feedback signal $P_{MEAS}$, the power sensing circuit 22 multiplies the output current and the output voltage. The power-representative feedback signal $P_{MEAS}$ is then compared to $P_{REF}$ in a comparator within the power factor controller 24.

Although not shown in FIG. 1, it is to be understood that the light source 2 may also include other circuits and components, including, but not limited to, an electronic safeguarding circuit, an input under/over voltage circuit, a start-up circuit, an input reference current sense, a dimming option circuit, and/or a light-out detection circuit, all as known to a person having ordinary skill in the art.

It is to be appreciated that LED manufacturers typically bin or separate LEDs subsequent to a production run. Due to typical variations during manufacturing, each LED may possess and exhibit a unique set of characteristics. LED manufactures normally bin according to three primary characteristics. The intensity bins segregate components in accordance with luminous output. Color bins provide separation for variations in optical wavelength or color temperature. Voltage bins divide components according to variations of their forward voltage rating.

Referring now to FIG. 2A, which is a graph showing LED current ($I_{LED}$) measurements at various binnings with respect to LED forward voltage variations when no power control circuitry according to the present invention is incorporated. In FIG. 2A, note that temperature $\theta_1$ is lower than temperature $\theta_2$, which is itself lower than temperature $\theta_3$. Note that at a reference LED current ($I_{LEDref}$), the LED voltage corresponding to Bin A $V_{F1}$ is greater than the LED voltage corresponding to Bin A $V_{F2}$, which is itself greater than the LED voltage corresponding to Bin A $V_{F3}$, and the same characteristics hold for the LED voltages corresponding to Bin B $V'_{F1}$, $V'_{F2}$ and $V'_{F3}$, respectively.

Turning now to FIG. 2B, LED current ($I_{LED}$) measurements at various agings are shown with respect to LED forward voltage variations when no power control circuitry according to the present invention is incorporated. In FIG. 2B, temperature $\theta_1$ is lower than temperature $\theta_2$, which is itself lower than temperature $\theta_3$. Note that at a reference LED current ($I_{LEDref}$), the LED voltage corresponding to Aging1 $V_{FA1}$ is greater than the LED voltage corresponding to Aging1 $V_{FA2}$, which is itself greater than the LED voltage corresponding to Aging1 $V_{FA3}$, and the same characteristics hold for the LED voltages corresponding to Aging2 $V'_{FA1}$, $V'_{FA2}$ and $V'_{FA3}$, respectively.

FIG. 3A is a graph of LED Power ($P_{MEAS}$) measurements at various binnings with respect to LED forward voltage when no power control circuitry according to the present invention is incorporated. In FIG. 3A, temperature $\theta_1$ is lower than temperature $\theta_2$, which is itself lower than temperature $\theta_3$. Note that at a reference LED constant current ($I_{LEDref}$), the LED power corresponding to Bin A P-BinA-θ1 is greater than the LED power corresponding to Bin A P-BinA-θ2, which is itself greater than the LED power corresponding to Bin A P-BinA-θ3, and the same thing holds for Bin B: P-BinB-θ1>P-BinB-θ2>P-BinB-θ3.

Figure 3B:
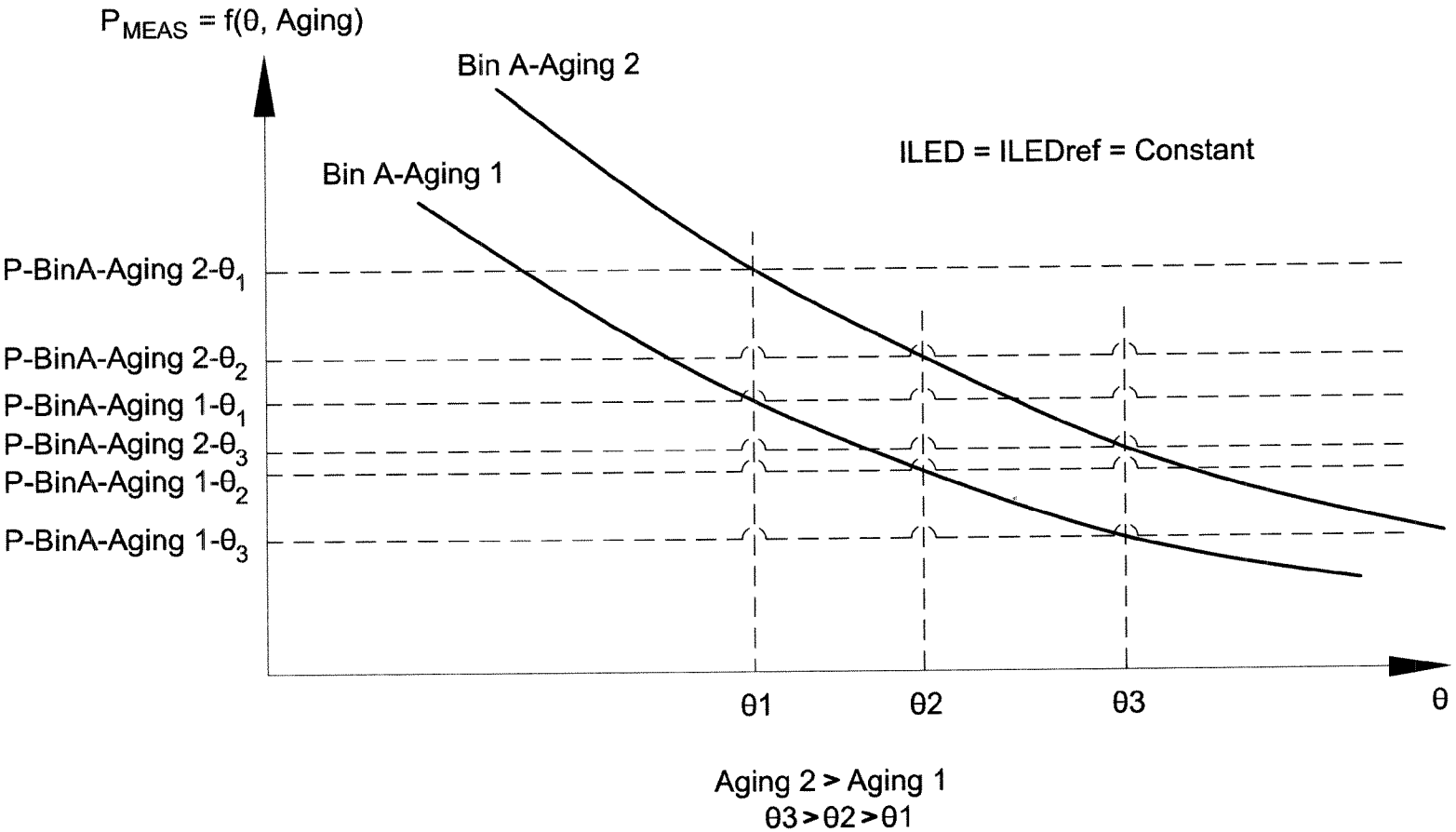
FIG. 3B is a graph showing LED output power as a function of temperature and LED aging.

FIG. 3B is a graph of LED Power ($P_{MEAS}$) measurements at various agings with respect to LED forward voltage when no power control circuitry according to the present invention is incorporated. In FIG. 3B, note that at a reference LED constant current ($I_{LEDref}$), the LED power corresponding to Aging1, P-Aging1-θ1 is greater than the corresponding to LED power corresponding to Aging1, P-Aging1-θ2, which is itself greater than the LED power corresponding to Aging1, P-Aging1-θ3, and the same thing holds for Aging2: P-Aging2-θ1>Aging2, P-Aging2-θ2>Aging2, P-Aging1-θ3.

FIG. 3A shows that without the power sense circuit 20 of this invention, at a lower temperature ($\theta_1$), the LED output power $P_{MEAS1}$ at a given $V_F$ binning is higher, and at the higher temperature ($\theta_3$), the LED output power $P_{MEAS3}$ is lower at a given $V_F$ binning. Also, at a lower temperature ($\theta_1$), the LED output power $P_{MEASA1}$ at a given aging is higher, and at the higher temperature ($\theta_3$), the LED output power $P_{MEASA3}$ is lower at given aging, that is:

$$P_{MEAS1}>P_{MEAS2}>P_{MEAS3} \tag{2}$$

Accordingly, in order to avoid variations in the LED output power $P_{MEAS}$ with temperature $\theta_1$, aging and $V_F$ binning at a fixed current, the power sensing circuit 20 has been introduced. The LED power-representative voltage signal $P_{MEAS}$ is given by the product of LED current $I_{LED}$ (from the LED current sensing circuit 16) and LED Forward Voltage $V_{LED}$ (from the LED voltage sensing circuit 18).

The LED power-representative voltage signal $P_{MEAS}$ has an amplitude that is proportional to the magnitude of the current flowing through the LEDs 14 and the voltage across the LEDs 14. The power sensing circuit 20 enables regulation of the dc power supplied to the LEDs as a function of temperature θ, $V_F$ binning and aging. When the temperature θ is constant, $P_{MEAS}$ as generated by the power sensing circuit 20 will depend only on $V_F$ binning and aging.

We refer now to FIGS. 4A and 4B, which represent the effect of the power control circuitry being incorporated into the light source 2. As shown in FIGS. 4A and 4B, when the temperature 0 rises, the forward voltage decreases, and then the power factor controller 24 increases the LED current by sending a signal to the power converter 10 to increase the current) to maintain the power consumption constant such that:

$$P_{MEAS}=V_{LED}(\theta)\times I_{LED}(\theta)=\text{constant}=P_{REF} \tag{3}$$

and the current on the LEDs is:

$$I_{LED}(\theta)=P_{REF}/V_{LED}(\theta) \tag{4}$$

where $P_{REF}$ is the fixed LED power reference.

As a result, the LED voltage $V_{LED}$ diminishes, and the difference E between the fixed reference power $P_{REF}$ and the filtered LED load power measurement $P_{MEAS}$ increases, so that the LED current is increased by the power converter 10 until the difference E is equal to zero:

$$E=P_{REF}-P_{MEAS} \tag{5}$$

The power drawn by the LED load 4 is therefore limited by the choice of $P_{REF}$ This, in turn, maintains a roughly constant power output from the LED load 4.

Conversely, if the temperature θ drops, the LED voltage $V_{LED}$ increases, and the power factor controller 24 increases the LED current by sending a signal to the power converter 10 to increase the current to maintain the power constant and equal to $P_{REF}$. As a result, $P_{MEAS}$ increases, and the difference E decreases so that the power converter 10 decreases the current in the LED load 4 until the difference E is again equal to zero.

The LED lamp power output regulation is based on the variation of forward voltage measurement with temperature and aging as shown in FIGS. 4A and 4B.

Thus, in accordance with aspects of the present invention, the power of the LEDs may be adjusted so that if any of the LED electrical characteristics changes, the LED power consumption stays constant. If the LED forward voltage varies, for example, with (a) temperature, (b) a manufacturer batch to batch, (c) manufacturer $V_F$ binning, or (d) age, the LED current may be adjusted to maintain the same power consumption. The LED power consumption can also be changed in function of the line input voltage resulting in LED efficiency having a low variation in terms of lumen per watt but having a high variation in terms of voltage for a specific current.

The output power reference can be adjusted by the customer as a dimming option. An input reference current sensor is generally proportional to the output power $P_{MEAS}$, so by fixing the reference current, the output power reference can be fixed proportionally and then the dimming option can be executed with the same power consumption in all temperature environments, binning $V_F$ variations and age variations (time).

Figure 5:
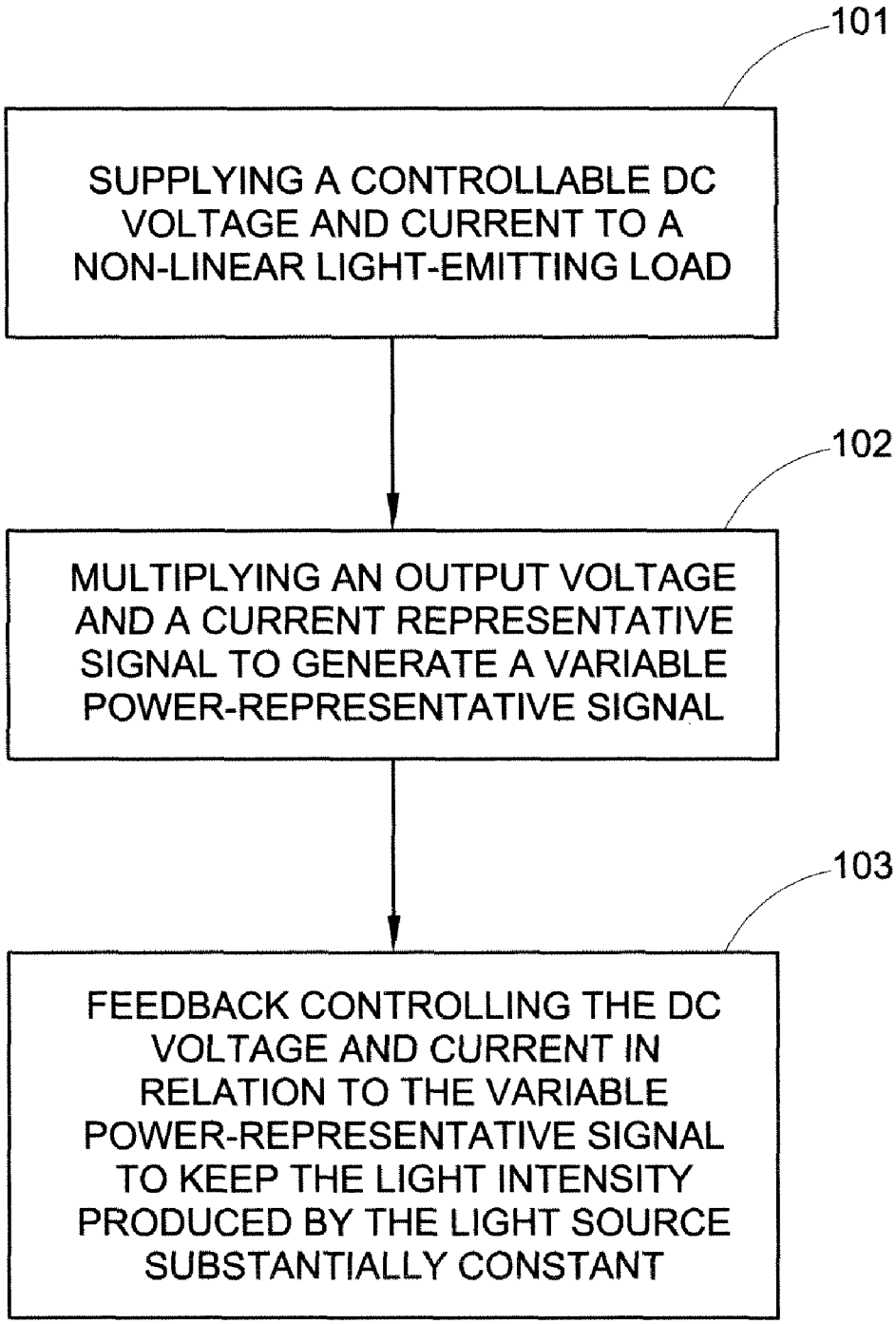
FIG. 5 is a flow chart illustrating an exemplary method of maintaining the intensity and power consumption of a light source substantially constant.

An exemplary method of maintaining the intensity and power consumption of a light source substantially constant, in accordance with the exemplary embodiment shown in FIG. 1 and described above, is presented in FIG. 5. The method includes (a) supplying power from a controllable power source to a non-linear light-emitting load such as a set of LEDs (101); (b) multiplying an output forward voltage and a variable current-representative signal from the light-emitting load to generate a variable power-representative signal (102); and (c) feedback controlling the power source in relation to the variable power-representative signal to maintain the light intensity produced by the light source substantially constant (103).

The above description merely provides a disclosure of particular embodiments of the invention and is not intended for the purposes of limiting the same thereto. As such, the invention is not limited to only the above-described embodiments. Rather, it is recognized that one of ordinary skill in the art could conceive alternative embodiments that fall within the scope of the invention.

We claim:

1. A light source comprising:

a controllable power source for supplying power to a non-linear light-emitting load;

a current sensing circuit connected to the non-linear light-emitting load that generates a current representative signal representing the current flowing through the non-linear light-emitting load;

a voltage sensing circuit connected to the non-linear light-emitting load that generates a voltage representative signal representing the voltage across the non-linear light-emitting load;

a power sensing circuit connected to the current and voltage sensing circuits that receives the current and voltage representative signals and determines the power consumption of the light-emitting load and generates a power-representative signal; and a power feedback control circuit connected between the power sensing circuit and the controllable power source through which the power source is controlled in relation to the power-representative signal to maintain the power consumption of the light source substantially constant, wherein the power feedback control circuit comprises:

a comparison circuit having a first input for receiving the power-representative signal, a second input for receiving a fixed power-representative reference signal, and an output for producing a comparison-representative signal representative of a comparison between the power-representative signal and the fixed power-representative reference signal; and a controller through which the power source is controlled in relation to the comparison-representative signal to adjust the output of the power supply such that the power consumption and light intensity produced by the light source are substantially constant.

2. The light source as defined in claim 1, wherein the power consumption of the light-emitting load vanes as a result of at least one of an environmental condition of operation, manufacturer forward voltage binning batch and age of the light-emitting load.

3. The light source as defined in claim 1, wherein the voltage sensing circuit produces a voltage representative signal, the voltage varying with the temperature, binning batch and aging of the light-emitting load.

4. The light source as defined in claim 1, wherein the power consumption and light source intensity are kept substantially constant within a given temperature range.

5. The light source as defined in claim 1, wherein the non-linear light-emitting load comprises a plurality of subsets of serially interconnected LEDs.

6. The light source as defined in claim 5, wherein the subsets of serially interconnected LEDs are connected in parallel.

7. The light source as defined in claim 1, further comprising at least one of the following circuits:

an electronic safeguarding circuit;

an input under/over voltage circuit;

a start-up circuit;

an input reference current sense circuit;

a dimming option circuit; and a light-out detection circuit.

8. A method of maintaining the intensity and power consumption of a light source substantially constant, the method comprising:

supplying a controllable dc voltage and current to a non-linear light-emitting load;

multiplying an output forward voltage and a current-representative signal from the light-emitting load to generate a power-representative signal; and feedback controlling the controllable dc voltage and current in relation to the power-representative signal to keep the light intensity produced by the light source substantially constant, wherein feedback controlling further comprises:

comparing the power-representative signal and a fixed power-representative reference signal to produce a comparison-representative signal representative of a comparison between the power-representative signal and the fixed power-representative reference signal; and controlling the controllable dc voltage and current in relation to the comparison-representative signal to adjust the dc voltage and current such that the power consumption and light intensity produced by the light source are substantially constant.

9. The method as defined in claim 8, wherein the non-linear light-emitting load comprises a plurality of subsets of serially interconnected LEDs.

10. The method as defined in claim 9, wherein the subsets of serially interconnected LEDs are generally connected in parallel.

11. A substantially constant intensity LED lamp comprising:

a controllable dc voltage and current source for supplying an LED load with dc voltage and current;

a current sensing circuit connected with the LED load that generates a current representative signal representing the current flowing through the LED load;

a voltage sensing circuit connected with the LED load that generates a voltage representative signal representing the voltage across the LED load;

a multiplier circuit that receives the current signal and the voltage signal and generates a power representative signal; and a voltage and current control feedback circuit connected between the multiplier circuit and the controllable dc voltage and current source that receives the power representative signal and controls the dc voltage and current source in relation to the power-representative signal to thereby adjust the dc voltage and current to keep the light intensity and power consumption produced by the LED load substantially constant, wherein the voltage and current control feedback circuit comprises:

a comparison circuit having a first input for receiving the power-representative signal, a second input for receiving a fixed power-representative reference signal, and an output for producing a comparison-representative signal representative of a comparison between the power-representative signal and the fixed power-representative reference signal; and a controller through which the dc voltage and current source is controlled in relation to the comparison-representative signal to adjust the dc voltage and current to amplitudes that keep the power consumption and light intensity produced by the light source substantially constant.

12. The LED lamp as defined in claim 11, wherein the power representative signal varies as a result of at least one of an environmental condition of operation, manufacturer forward voltage binning batch and the age of the light-emitting load.

13. The LED lamp as defined in claim 11, wherein the voltage sensing circuit includes an output for delivering the forward voltage representative signal, the voltage varying with the temperature, binning batch and aging of the light-emitting load.

14. The LED lamp as defined in claim 11, wherein the power consumption and light source intensity are kept substantially constant within a given temperature range.

15. The LED lamp as defined in claim 14, wherein the LED load comprises a plurality of subsets of serially interconnected LEDs.

16. The LED lamp as defined in claim 15, wherein the subsets of serially interconnected LEDs are connected in parallel.

17. The LED lamp as defined in claim 16, further comprising at least one of the following circuits:

an electronic safeguarding circuit;

an input under/over voltage circuit;

a start-up circuit;

an input reference current sense circuit;

a dimming option circuit; and a light-out detection circuit.

* * * * *